US012042046B2

(12) United States Patent
Bonin

(10) Patent No.: US 12,042,046 B2
(45) Date of Patent: Jul. 23, 2024

(54) DEVICE FOR MOVING ELEMENTS FOR CONTAINING PRODUCTS FOR A CORNER CABINET

(71) Applicant: Vibo S.p.A., Trissino (IT)

(72) Inventor: Francesco Bonin, Trissino (IT)

(73) Assignee: VIBO S.P.A., Trissino (IT)

( * ) Notice: Subject to any disclaimer, the term of this patent is extended or adjusted under 35 U.S.C. 154(b) by 0 days.

(21) Appl. No.: 17/286,315

(22) PCT Filed: Oct. 17, 2019

(86) PCT No.: PCT/IB2019/058871
§ 371 (c)(1),
(2) Date: Apr. 16, 2021

(87) PCT Pub. No.: WO2020/079643
PCT Pub. Date: Apr. 23, 2020

(65) Prior Publication Data

US 2021/0386200 A1 Dec. 16, 2021

(30) Foreign Application Priority Data

Oct. 17, 2018 (IT) ..... 102018000009551

(51) Int. Cl.
*A47B 88/497* (2017.01)

(52) U.S. Cl.
CPC .... *A47B 88/497* (2017.01); *A47B 2210/0002* (2013.01)

(58) Field of Classification Search
CPC ..... A47B 88/497; A47B 2210/0002
(Continued)

(56) References Cited

U.S. PATENT DOCUMENTS 3,863,279 A * 2/1975 Stalder ..... A47B 53/00 5/8
4,582,372 A * 4/1986 Cooper ..... A47B 81/002 312/307

(Continued)

FOREIGN PATENT DOCUMENTS

DE 4323407 * 1/1995 ..... A47B 53/00
DE 19514009 A1 10/1996

(Continued)

OTHER PUBLICATIONS

International Search Report for PCT/IB2019/058871 dated Feb. 4, 2020 (4 pages).

(Continued)

*Primary Examiner* — James O Hansen
(74) *Attorney, Agent, or Firm* — Tutunjian & Bitetto, P.C.

(57) ABSTRACT

A movement device installable in a corner cabinet includes at least one frame, for supporting at least one first containment element and at least one second containment element placeable mutually side by side in horizontal direction, first guide means for translating the at least one first containment element along a first drive direction and second guide means for translating the at least one second containment element along a second drive direction, wherein the first guide means are operatively connected to the frame so as to allow the movement of the at least one first containment element only along the first drive direction.

9 Claims, 6 Drawing Sheets

(58) Field of Classification Search
USPC ..... 312/238
See application file for complete search history.

(56) References Cited

U.S. PATENT DOCUMENTS

| | | | | | |
|---|---|---|---|---|---|
| 5,662,398 | A * | 9/1997 | Swallow | ..... | A47B 67/04<br>312/238 |
| 5,941,620 | A * | 8/1999 | Weber | ..... | A47B 81/002<br>312/238 |
| 2015/0196120 | A1 | 7/2015 | Hunter | | |

FOREIGN PATENT DOCUMENTS

| | | | | | |
|---|---|---|---|---|---|
| EP | 0797942 | A2 | | 10/1997 | |
| FR | 2625658 | A1 | | 7/1989 | |
| WO | WO 2004/091344 | | * | 10/2004 | ..... A47B 81/00 |

OTHER PUBLICATIONS

Written Opinion for PCT/IB2019/058871 dated Feb. 4, 2020 (5 pages).

* cited by examiner

DEVICE FOR MOVING ELEMENTS FOR CONTAINING PRODUCTS FOR A CORNER CABINET

TECHNICAL FIELD OF THE INVENTION

The present invention regards a device associable with a corner cabinet for the purpose of supporting and moving the elements for containing products, such as baskets or drawers or the like, relative to the off-centered access opening in such corner cabinet.

STATE OF THE ART

With reference to the interior design sector, in particular to that pertaining to kitchen cabinets, it is known to use articulated mechanical devices in order to allow the reversible movement of baskets for containing products from within the cabinet to the exterior thereof, and vice versa.

In particular, such mechanical devices have use within corner cabinets which, as is known, have an off-centered opening for entrance within the cabinet itself. In fact, in a similar cabinet, a corner is not directly accessible.

Such mechanical devices can comprise a pair of containment baskets, aligned with each other horizontally within the cabinet, and movable along a horizontal plane. The two baskets are operatively connected to each other, in a manner such that a first basket can be moved for extraction outside the corner cabinet, through the off-centered opening, and cause, during its exit, the translation of a second containment basket closer to the off-centered opening, so as to face the same, thus resulting accessible.

The first basket is connected to the structure of the cabinet, and in particular to a vertical wall in proximity to the off-centered opening, by means of a single linear guide which allows the exiting or entering translation thereof relative to the cabinet. The linear guide is in turn connected by means of a hinge to the wall of the cabinet, in a manner such to allow the rotation of the guide itself, and of the basket associated therewith, around a vertical rotation axis.

Following the rotation of the guide, the movement is caused of the second basket associated with the first basket.

On such matter, it is observed that in order to allow the approaching of the second basket in proximity to the off-centered opening, it is necessary to extract the first basket, making it translate outwards from the cabinet and then, rotate the first basket away from the off-centered opening, drawing the second basket which, as stated above, is operatively connected to the first.

The first basket and the second basket are mutually connected by means of an articulated system of arms configured for causing the translation of the second basket following the rotation of the first basket positioned outside the corner cabinet.

Such movement device, even if it allows moving both the first basket and the second basket between an initial position, in which both are positioned within the corner cabinet, and a second position in which both the baskets are accessible, has a high structural complexity.

The movement device, in fact, provides for the use of a single guide associated with the first basket, in proximity to one side thereof, which in turn must be connected by means of a hinge to the corner cabinet.

Indeed, the first basket is only supported on one side, thus being connected on one side in an unbalanced manner to the cabinet. The side opposite that of connection of the first guide is in fact cantilevered, hence requiring the use of a guide of considerable strength in order to support the weight of the products placed within the basket and still ensure a smooth movement of the basket itself, without jamming.

There is the need in the field to provide a device for moving a pair of baskets relative to an internal compartment of a corner cabinet, which is practical to use and efficient, in the scope of a solution that is structurally simpler than that belonging to the abovementioned prior art.

There is also the need to provide a device for moving a pair of baskets, horizontally side-by-side each other, which is usable in a corner cabinet and which has an off-centered opening at a right portion of the cabinet or alternatively at a left portion of the corner cabinet, in the scope of a solution with flexible use.

Today, in fact, a left version and a right version of the components constituting the movement device must be attained, as a function of the relative position of the off-centered opening with respect to the corner cabinet, determining an increase of the production costs of the device itself, as well as requiring the manufacturer to store a high number of components.

Such requirement inevitably causes an increase of the production costs of the abovementioned movement devices.

SUMMARY OF THE INVENTION

Hence the main object of the present invention is to improve the state of the art relative to a device for moving a pair of elements for supporting and containing products, configured as baskets or drawers, side-by-side each other within a corner cabinet.

In the scope of such task, one object of the present invention is to provide a device for moving elements for supporting and containing products for a corner cabinet which is practical and easy to use, in the scope of a solution that is efficient from a mechanical standpoint.

Another object of the present invention is to provide a device for moving elements for supporting and containing products for a corner cabinet that has a simplified structure, with a reduced number of components with respect to the solutions of conventional type.

A further object of the present invention is to provide a device for moving a pair of support and containment elements which is usable in a corner cabinet provided with an off-centered opening, independent of the relative position of such opening with respect to the cabinet itself.

Another object of the present invention is to provide a device for moving and supporting a pair of containment elements for a corner cabinet which allows optimally exploiting the free volume within the cabinet itself.

According to one aspect of the present invention, a device is provided for supporting and moving at least one pair of product containment elements according to the present application.

The present application refers to preferred and advantageous embodiments of the invention.

BRIEF DESCRIPTION OF THE DRAWINGS

Further characteristics and advantages of the present invention will be more evident from the detailed description of a preferred but not exclusive embodiment of a device for supporting and moving at least one pair of containment elements such as baskets or drawers, illustrated as a non-limiting example in the enclosed drawing tables, in which.

DETAILED DESCRIPTION

Figure 1:
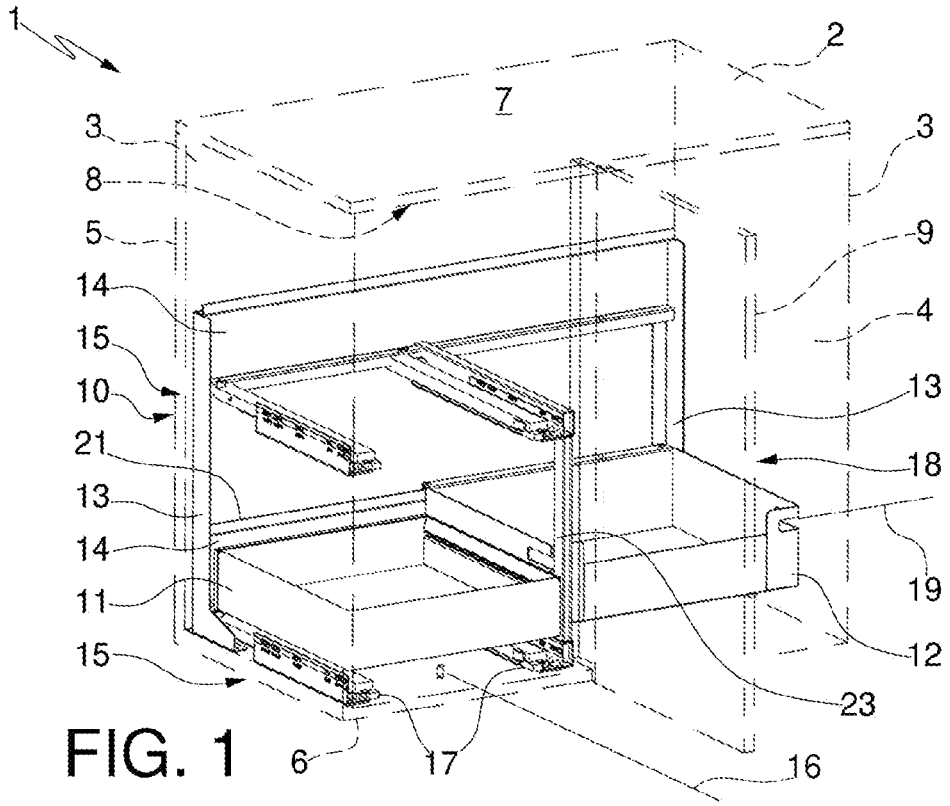
FIG. 1 is a front perspective view of a cabinet comprising a device for supporting and moving containment elements according to the present invention.

With reference to the enclosed figures, a device for supporting and moving at least one pair of containment elements, such as baskets or drawers, is indicated overall with reference number 1.

The supporting and moving device 1, hereinbelow indicated as movement device 1 for the sake of brevity, is associable within a corner cabinet 2 of the type described above in relation to the state of the art.

A corner cabinet 2 comprising a movement device 1 installed at its interior also forms the object of the present invention.

In the enclosed figures, the corner cabinet 2, if illustrated, is represented transparent by means of a non-continuous dashed line in order to facilitate a greater comprehension of the movement device 1 installed at its interior.

As an example, the corner cabinet 2 can have a pair of lateral walls 3 that are opposite each other, a wall that is a front wall 4 during use and a wall that is a rear wall 5 during use, which extend upward from a base 6 and are delimited on the upper part by a horizontal upper wall 7, which define a compartment inside the corner cabinet 2 itself in which the movement device 1 is installable.

The corner cabinet 2 has an off-centered opening 8 made along the front wall 4.

The off-centered opening 8 identifies a vertical access plane within the corner cabinet 2. At the off-centered opening 8, a door 9 can be movably associated for the selective closure of said opening 8.

In the following description, reference will be made by way of a non-limiting example to a corner cabinet 2 which has an off-centered opening at the left portion of the front wall 4.

It is intended that the movement device 1 can be equally used if the off-centered opening is made at the right portion of the front wall 4, without requiring the use of further or different components with respect to those described in relation to the installation of the movement device 1 in a corner cabinet that has an off-centered opening on the left, as will be better described hereinbelow.

The movement device 1 comprises at least one frame 10 for supporting at least one first containment element 11 and at least one second containment element 12.

The at least one first containment element 11 and the at least one second containment element 12 are associated along the frame 10 mutually side-by-side in horizontal direction.

The at least one first containment element 11 is susceptible of reversibly passing between a retracted position, in which it is completely within the corner cabinet 2, and an extracted position, in which it is placed completely outside the corner cabinet 2, frontally with respect to the off-centered opening 8.

The at least one second containment element 12 is instead susceptible of reversibly passing between a first position, in which it is placed away from the off-centered opening 8, and a second access position, in which it is placed in proximity to the off-centered opening 8, facing the same and thus being easily accessible.

In the enclosed figures, the at least one first containment element 11 and the at least one second containment element 12 are depicted as drawers, even if the same can be baskets or grid-like shelves or equivalent elements for supporting and containing products without any limitation. As an example, the same can be configured for supporting elongated articles such as bottles or the like, or pots/pans or articles of any shape.

The frame 10 can comprise a pair of brackets or lateral columns 13 adapted to support at least one horizontal crosspiece 14.

The frame 10 is associable within the corner cabinet 2, by means of connection means of removable type, such as screws or the like or by means of a connection of permanent type without any limitation, so as to provide a stable support or a support that can be easily installed for the at least one first containment element 11 and the at least one second containment element 12.

With reference to the enclosed FIGS. 1 to 5, the frame 10 can comprise at least one horizontal crosspiece 14 for supporting a first containment element 11 and a corresponding second containment element 12.

In accordance with a further version of the present invention, the frame 10 can comprise a pair of horizontal crosspieces 14, stacked in a spaced position with respect to each other, for the purpose of providing a first support for a first containment element 11 and a second containment element 12 and a second support for a first containment element 11 and a corresponding second containment element 12, positioned at a greater height. According to a further version of the present invention, not illustrated in the enclosed figures, the movement device 1 can comprise a first frame 10, connectable within the corner cabinet 2, comprising a single horizontal crosspiece 14, for supporting a first containment element 11 and a second containment element 12, and a second frame 10 configured analogously to the first, for supporting a further first containment element 11 and a further second containment element 12 above the first frame 10.

According to one version of the present invention, not illustrated in the enclosed figures, in place of a door 9 rotatably connected to the corner cabinet 2, a front panel can be present that is connected to the at least one first containment element 11 in order obstruct or free the off-centered opening 8 as a function of the movement of the at least one containment element 11 itself.

On such matter, it is observed that if a plurality of first containment elements 11 are present which are operatively connected within the corner cabinet 2 in a superimposed position with respect to each other, the movement device 1 could comprise single frontal panels, each connected to a respective first containment element 11 for the same above-described aims.

The movement device 1 comprises first guide means 15, in order to guide the movement of the at least one first containment element 11 along a first drive direction 16.

In particular, the first guide means 15 are configured for translating the at least one first containment element 11 along the first drive direction 16.

The first drive direction 16 is perpendicular to at least one horizontal crosspiece 14 of the frame 10.

Figure 4:
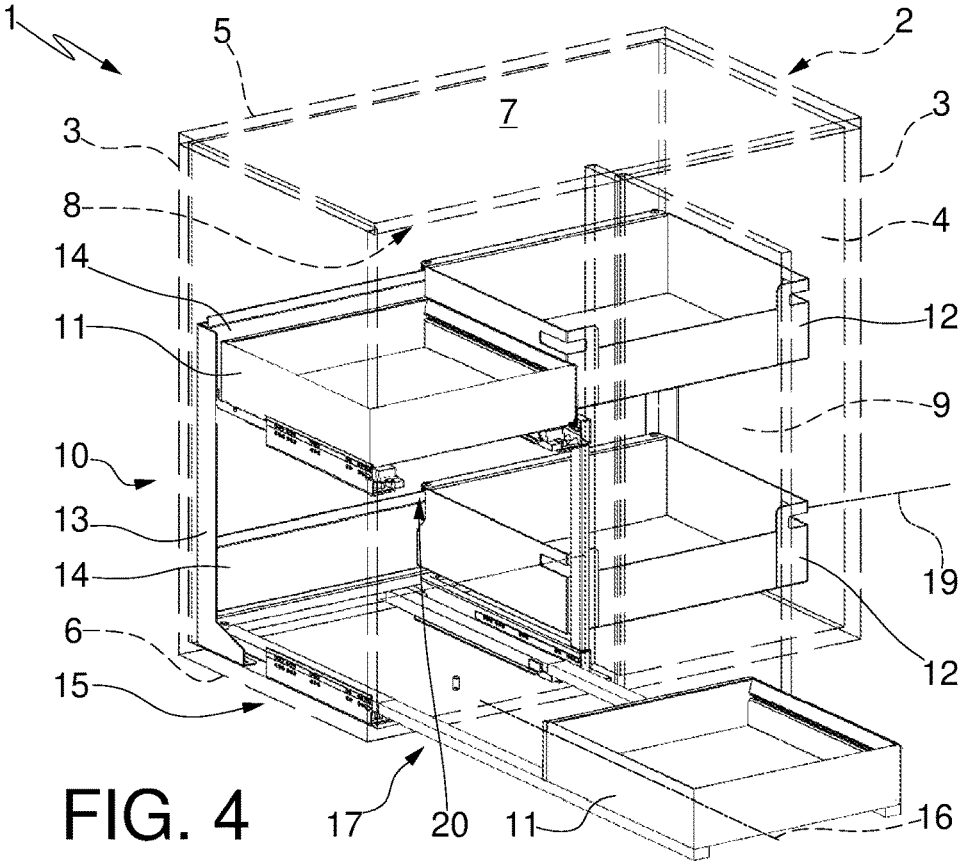
Figure 5:
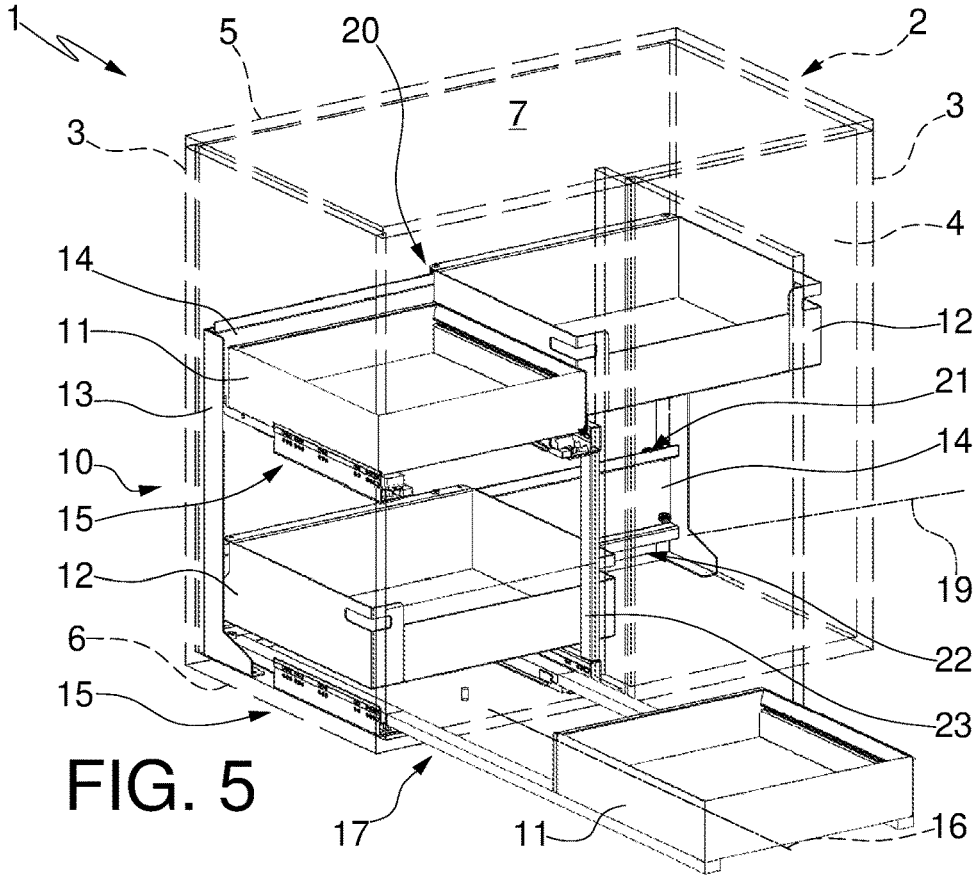

Indeed, the first guide means 15 identify the first drive direction 16, guiding the translation of the at least one first containment element 11, relative to the off-centered opening 8, reversibly between a position inside the corner cabinet 2 (see FIGS. 1 and 2) and an external position in which the at least one containment element 11 itself is placed completely outside the corner cabinet 2 (see FIG. 4).

The first guide means 15 are configured for only allowing the translation of the at least one containment element 11 along the first drive direction 16, preventing any rotation of the at least one containment element 15 relative to the corner cabinet 2.

The first guide means 15 are operatively connected to the frame 10 so as to allow the movement of the at least one first containment element 11 only along the first drive direction 16.

The first guide means 15 can comprise a fixed portion associated with internal portions of the corner cabinet 2 or with the frame 10, not illustrated in detail in the enclosed figures, and at least one movable portion connected to the at least one first containment element 11.

The fixed portion and the movable portion of the first guide means 15 are slidably connected to each other by means of the interposition of suitable rolling means according to modes known in the field.

With reference to a preferred embodiment, illustrated in the enclosed figures, the first guide means 15 comprise two extendable linear guides 17 of type known in the field, each placed at a lateral side of the at least one first containment element 11.

According to one version of the present invention, the extendable linear guides 17 can be of the type with three elements slidably associated with each other in order to obtain a doubly-extended extension, according to modes that are known to the man skilled in the art.

The first guide means 15 allow firmly supporting the at least one first containment element 11 on both sides, and allowing the smooth and slidable actuation thereof, without jamming, along the first direction 16, thus overcoming a drawback which afflicts the solutions of conventional type that provide for the cantilevered support of the at least one containment element 11.

It is intended that the first guide means 15 in place of a pair of linear guides 17, could comprise a single extendable linear guide 17, not illustrated in the enclosed figures, positioned below the at least one first containment element 11, in central position, in order to in any case ensure a stable solution with smooth actuation, without jamming.

As stated above, the first guide means 15 can comprise at least one linear guide 17 of conventional extensible type which, therefore, will not be described in more detail.

The movement device 1 comprises second guide means 18, for guiding and moving the at least one second containment element 12 along a second drive direction 19, perpendicular to the first drive direction 16.

Indeed, the second guide means 18 define a slidable connection between the at least one second containment element 12 and the frame 10.

More precisely, the second guide means 18 define the connection of the at least one second containment element 12 to the at least one horizontal crosspiece 14 of the frame 10.

The at least one horizontal crosspiece 14 therefore identifies the second drive direction 19.

The second guide means 18 connect and guide the at least one second containment element 12 along the frame 10, allowing a sliding between a position inside the corner cabinet 2, moved away from the off-centered opening 8, and a use position, in which the at least one second element 12 faces the off-centered opening 8, resulting easily accessible.

It is observed that the movement of the at least one second containment element 12 along the second drive direction 19 can only occur after the extraction of the at least one first containment element 11 which actually frees, within the corner cabinet 2, the maneuvering space necessary for the movement of the at least one second containment element 12 itself.

According to a preferred embodiment, illustrated in the enclosed figures, the second guide means 18 can comprise rolling means 20 operatively connected to a rear portion of the at least one second containment element 12.

As an example, the rolling means 20 can be extended behind the at least one second containment element 12.

The rolling means 20 can be configured as small wheels or sliding blocks or the like without any limitation.

The at least one crosspiece 14 can comprise at least one first shaped portion or track 21 engageable by the rolling means 20.

According to one version of the present invention, the first track 21 can be made in the upper portion of the crosspiece 14, and has at least one surface along which the rolling means 20 are slidably placed in abutment.

The crosspiece 14 can also comprise a second shaped portion or track 22 made on the lower part, in a distal position with respect to the first track 21.

The second track 22, analogous to the first track 21, is slidably engageable by the rolling means 20.

The presence of the first track 21 and of the second track 22 along the at least one crosspiece 14, both engageable by the rolling means 20, allows obtaining a firm and stable connection of the at least one second containment element 12 to the frame 10, as well as ensuring a slidable smooth actuation without jamming.

Hereinbelow, a summary description is reported regarding the operation of the movement device 1.

With the at least one first containment element 11 and the at least one second containment element 12 both placed within the corner cabinet 2, mutually side-by-side in horizontal direction, the off-centered opening 8 is freed, by opening the possible door 9 if present (see FIG. 1).

Figure 3:
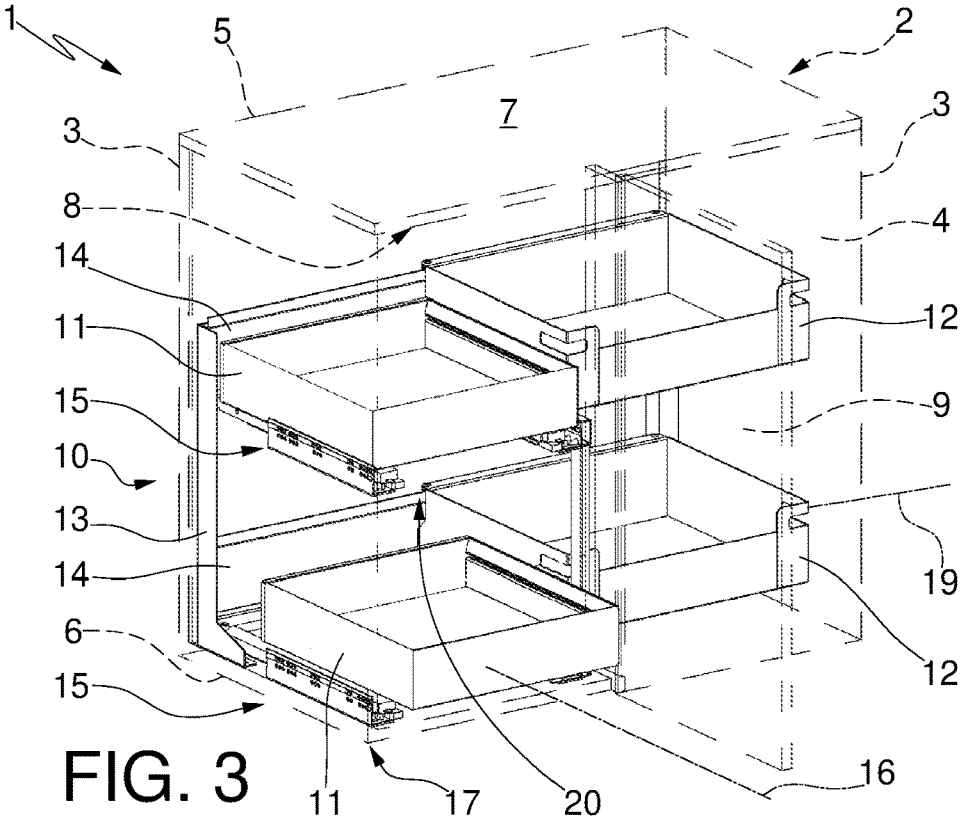
FIGS. 3 to 5 are front perspective views of a cabinet comprising a support and movement device according to the present invention, in which the device is illustrated in various operating positions.

Then, one frontally grasps the at least one first containment element 11 and a traction is exerted on the same, driving it to move along the first drive direction 16, up to bringing it outside the corner cabinet 2, through the off-centered opening 8 (see FIG. 3).

With the at least one first containment element 11 in a position completely extracted from the corner cabinet 2 (see FIG. 4), one grasps the at least one second containment element 12, at a lateral portion thereof, and one drives the same along the second drive direction 19 up to bring it in proximity to the off-centered opening 8. One then continues by continuing to drive the at least one second containment element 12 up to bringing it into an end stop position, in which the same faces through the off-centered opening 8, resulting easily accessible (see FIG. 5).

In order to reposition the containment elements 11 and 12 within the corner cabinet 2, one proceeds in a reverse manner, pushing the at least one second containment element 12 along the second direction 19, moving it away from the off-centered opening 8, freeing the maneuvering space for the at least one first containment element 11 and then pushing the latter within the corner cabinet 2 along the first drive direction 16.

The movement device 1 thus configured has a simple structure, comprising a limited number of components, capable of overcoming the drawbacks indicated in relation to the state of the art.

Contrary to the known solutions, in fact, the at least one first containment element 11 is stably supported, on both sides or centrally, unlike the conventional solutions which provide for the cantilevered support of such component.

The movement device 1 according to the present invention then provides a smooth actuation of the at least one first containment element 11 and of the at least one second containment element 12, without jamming, in the scope of a solution that has easy and facilitated use.

The containment elements 11 and 12 are both movable in an easy manner, requiring a limited number of maneuvers for rendering them accessible or for repositioning them within the corner cabinet 2.

As stated above, the movement device 1 can comprise a frame 10 provided with a first horizontal crosspiece 14 and with a second horizontal crosspiece 14, superimposed and spaced from each other in order to support respective first containment elements 11 and second containment elements 12 or, alternatively, a first frame 10 and a second frame 10 in a position superimposed and spaced from each other.

According to such version, the movement device 1 can comprise at least one vertical rod 23, associable with the corner cabinet 2 and more precisely with the base 6 and/or within the front wall 4, at the off-centered opening 8.

Figure 2:
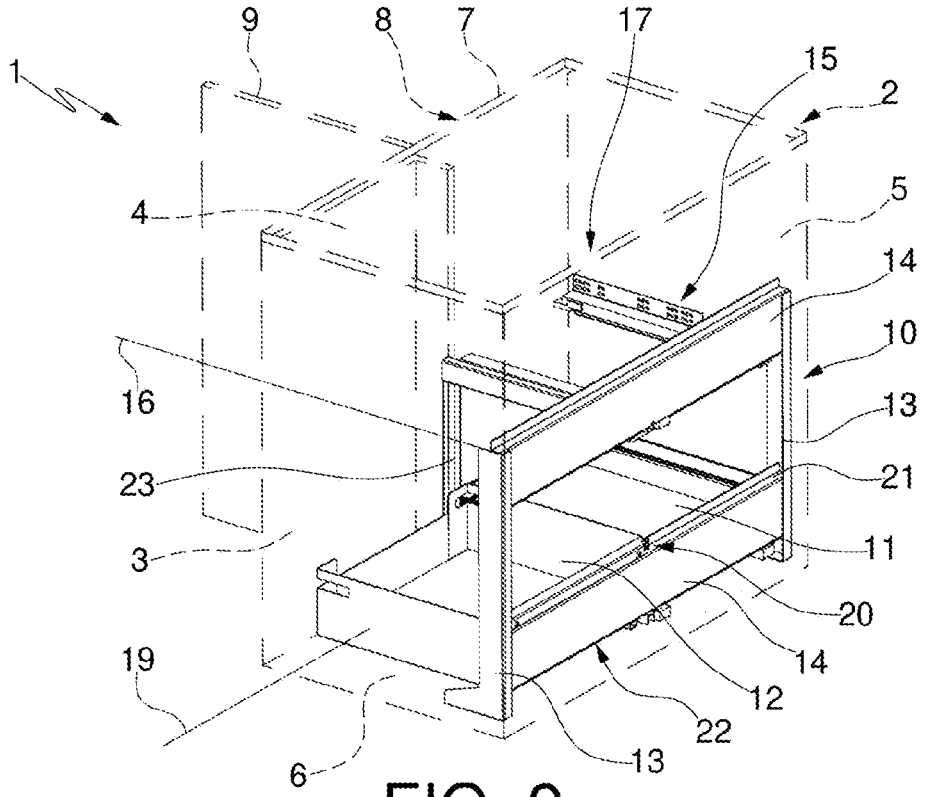
FIG. 2 is a rear perspective view of a cabinet comprising a support and movement device according to the present invention.

The vertical rod 23 provides an element of support for the first guide means 15 of the upper row of the first and second containment elements 11 and 12, on the opposite side with respect to the lateral wall 3 of the corner cabinet, in proximity to which the first containment elements 11 are installed (see FIGS. 1 and 2).

Indeed, a movement device 1 thus configured has a substantially castle-like support structure for the first containment elements 11 and the second containment elements 12, in order to stably support the upper row of first and second containment elements 11 and 12 and the lower row of first and second containment elements 11 and 12.

According to a further version of the present invention, illustrated in the enclosed FIGS. 6 to 13, the movement device 1 can further comprise a drive device, indicated overall with 24, in order to mutually connect the at least one first containment element 11 to the at least one second containment element 12.

The drive device 24 is configured to cause the movement of the at least one second containment element 12 following the displacement of the at least one first containment element 11.

Figure 13:
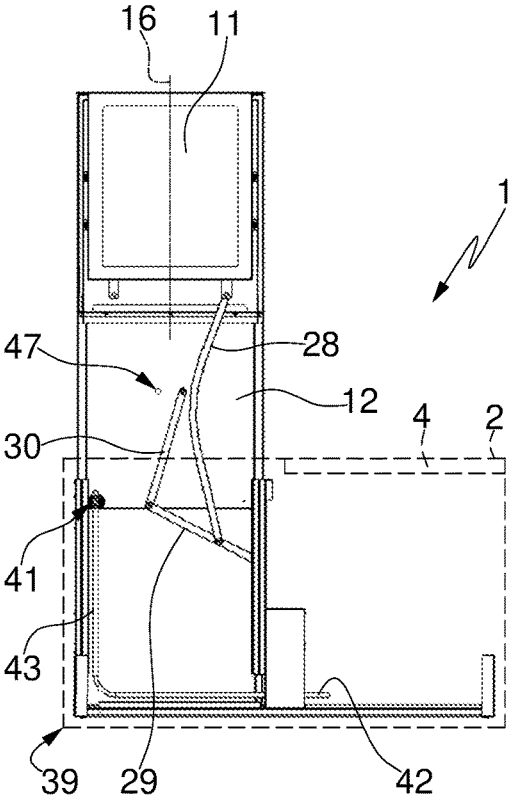

More precisely, following the displacement of the at least one first containment element 11 from the retracted position within the corner cabinet 2 (see FIG. 8) to the extracted position situated frontally with respect to the corner cabinet 2 (see FIG. 13), the drive device 24 causes a consequent displacement of the at least one second containment element 12 from the position moved away from the off-centered opening 8 (see FIG. 8) to the extracted position situated frontally with respect to the corner cabinet 2 (see FIG. 13).

The drive device 24 comprises a system of articulated levers, pins, guide means and relative abutment means adapted to interact with each other in order to reversibly obtain the driving of the at least one second containment element 12 following the displacement of the at least one first containment element 11 from the retracted position to the extracted position, and vice versa.

Figure 6:
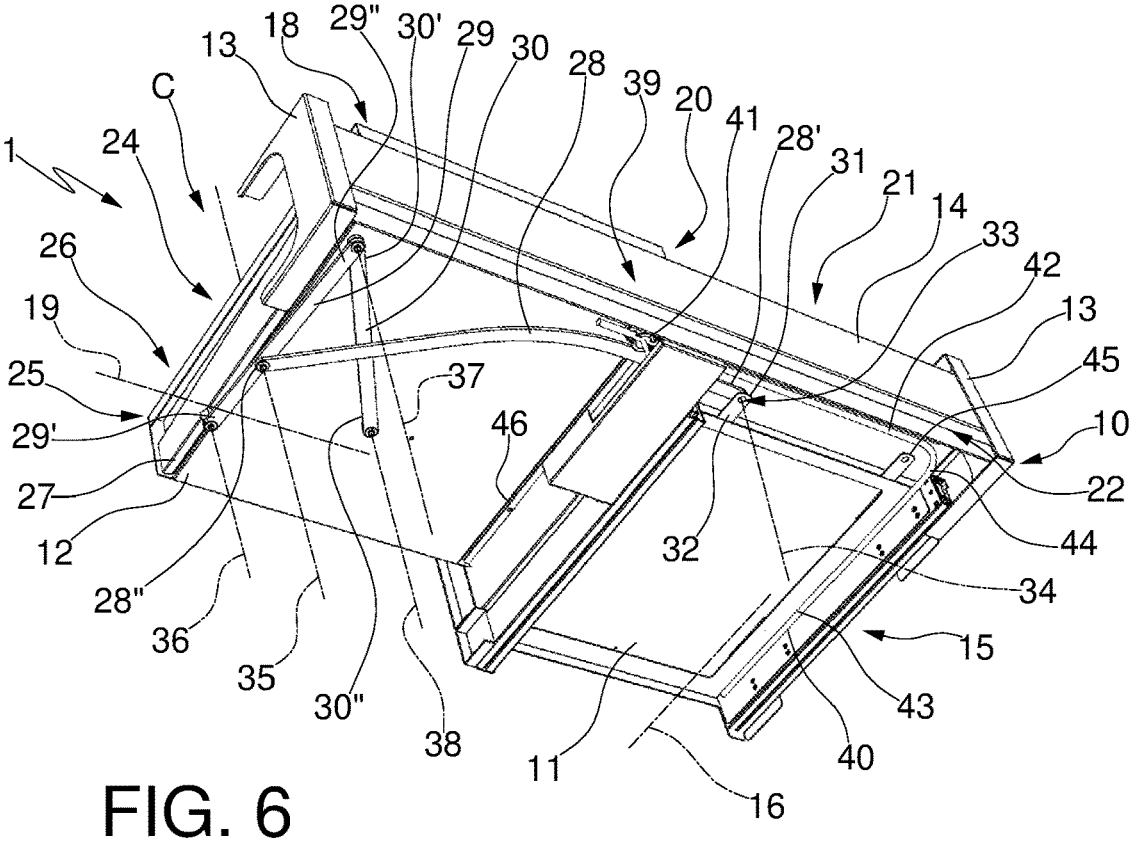
FIG. 6 is a detailed lower perspective view of a further version of the support and containment device according to the present invention.

The movement device 1 comprises third guide means 25 operatively connected to the at least one second containment element 12 and to the frame 10 in order to allow the movement of the at least one second containment element 12 along the first drive direction 16 (see for example FIG. 6).

The third guide means 25 can be associated with the opposite sides of the at least one second containment element 12.

The third guide means 25 comprise extensible guides which have fixed portions 26, connected to the second guide means 18, and respective movable portions 27 connected to the opposite sides of the at least one second containment element 12.

More in detail, the movable portions 27 are slidably associated with the fixed portions 26 by means of the interposition of rolling means, according to modes known in the field, not illustrated in detail in the enclosed figures.

Therefore, the at least one containment element 12 due to the second guide means 18 can translate along the second drive direction 19, as described above and, due to the third guide means 25, along the first drive direction 16.

In particular, the third guide means 25 allow the extraction of the at least one second containment element 12 placed facing the off-centered opening 8.

It is intended that the at least one second containment element 12, like the at least one first containment element 11, has dimensions such that it can be driven to be frontally extracted from the corner cabinet 2 through the off-centered opening 8 without interfering with the same.

The drive device 24 comprises a system of articulated levers C which operatively connect together the at least one first containment element 11, the at least one second containment element 12 and the third guide means 25.

The system of articulated levers C is positioned below the at least one first containment element 11, the at least one second containment element 12 and the third guide means 25, in a manner such to not interfere with their movement or the access within the containment elements 11, 12 themselves.

More in detail, the system of articulated levers C comprises a first lever 28, a second lever 29 and a third lever 30 hinged to each other to define an articulated caliper system. The first lever 28 has a first end 28' hinged to the at least one first containment element 11 and a second opposite end 28" hinged to the second lever 29.

More in detail, it is observed that the first end 28' can be connected to the first containment element 11 at a first connection point 31.

According to one version of the present invention, the at least one connection point 31 is during use provided in the rear portion of the at least one first containment element 11. As an example, at the rear portion, rear during use, of the at least one containment element 11, a bracket 32 can be projectingly extended which bears a seat 33 engageable with a pin or the like associable with the first end 28' in a manner so as to define the connection point 31 between the first lever 28 and the at least one containment element 11 itself (see FIGS. 6 and 8 to 13).

The first lever 28 can rotate around a first rotation axis 34, identified at the first connection point 31, and around a second rotation axis 35, at the connection of the same with the second lever 29.

The second lever 29 connects the third guide means 25 to the first lever 28 and to the third lever 30 as better described hereinbelow.

More in detail, the second lever 29 has a first end 29' hinged below the third guide means 25 and a second opposite end 29" hinged to the third lever 30. In addition, the second lever 29 is connected to the second end 28" of the first lever 28.

The second lever 29 can in fact rotate around a third rotation axis 36, at the connection between the first end 29' of the second lever 29 itself and the third guide means 25.

The second lever 29, moreover, can rotate around a fourth rotation axis 37, at the connection between the second end 29" of the second lever 29 itself and the third lever 30.

It is also observed that the second lever 29 and the first lever 28 can rotate around the second rotation axis 35 identified at the hinge connection between the first lever 28 and the second lever 29.

Finally, the third lever 30 has a first end 30' rotatably connected to the second end 29" of the second lever 29 and a second end 30", opposite the first, connected below the at least one second containment element 12, by means of a rotatable connection.

The third lever 30 can rotate around the fourth rotation axis 37, at the connection between the third lever 30 and the second lever 29, and around a fifth rotation axis 38, at the connection with the at least one second containment element 12.

In the articulated system C, the first rotation axis 34, the second rotation axis 35, the third rotation axis 36, the fourth rotation axis 37 and the fifth rotation axis 38 are aligned parallel to each other, independent of the position assumed by the at least one first containment element 11 relative to the at least one second containment element 12, so as to ensure a movement of the levers comprised in such system that is smooth and without jamming.

It is also observed that the first axis 34 can translate along the first advancing direction 16 following the movement of the at least one first containment element 11.

Analogously, the fifth rotation axis 38, being connected to the second containment element 12, can translate along the first drive direction 16 or along the second drive direction 19 as a function of the movement of the second containment element 12 itself. The length and the shape of the single levers 28, 29 and 30 and the positioning of the relative connection points determine the motion laws for the movement of the at least one first containment element 11 along the first drive direction 16 and the driven actuation of the at least one second containment element 12 initially along the second drive direction 19 and subsequently along the first drive direction 16.

It is observed that according to the embodiment illustrated in the enclosed FIGS. 8 to 13, the first lever 28 can have at least one curvilinear shape portion, while the second lever 29 and the third lever 30 can be shaped linearly. It is intended that further embodiments are possible in which the single levers 28, 29 and 30 are configured differently as a function of specific use requirements.

As stated above, the system of articulated levers C causes the displacement of the at least one second containment element 12 as a function of the position assumed by the first containment element 11 relative to the corner cabinet 2.

The drive device 24 can comprise a cam system indicated overall with 39 in order to guide the at least one second containment element 12 along a pre-established path.

In particular, the cam system 39 comprises a cam path 40, such cam associably fixed to the frame 10 or within the corner cabinet 2, and a cam follower 41 constrained below the at least one second containment element 12.

The cam system 39 defines the path along which the at least one second containment element 12 is moved. Such path is extended along the second drive direction 19 and the first drive direction 16.

On such matter, it is indicated that the cam path 40 comprises a first linear section 42, which is extended aligned along the second drive direction 19, and a second linear section 43, which is extended aligned along the first drive direction 16.

Figure 7:
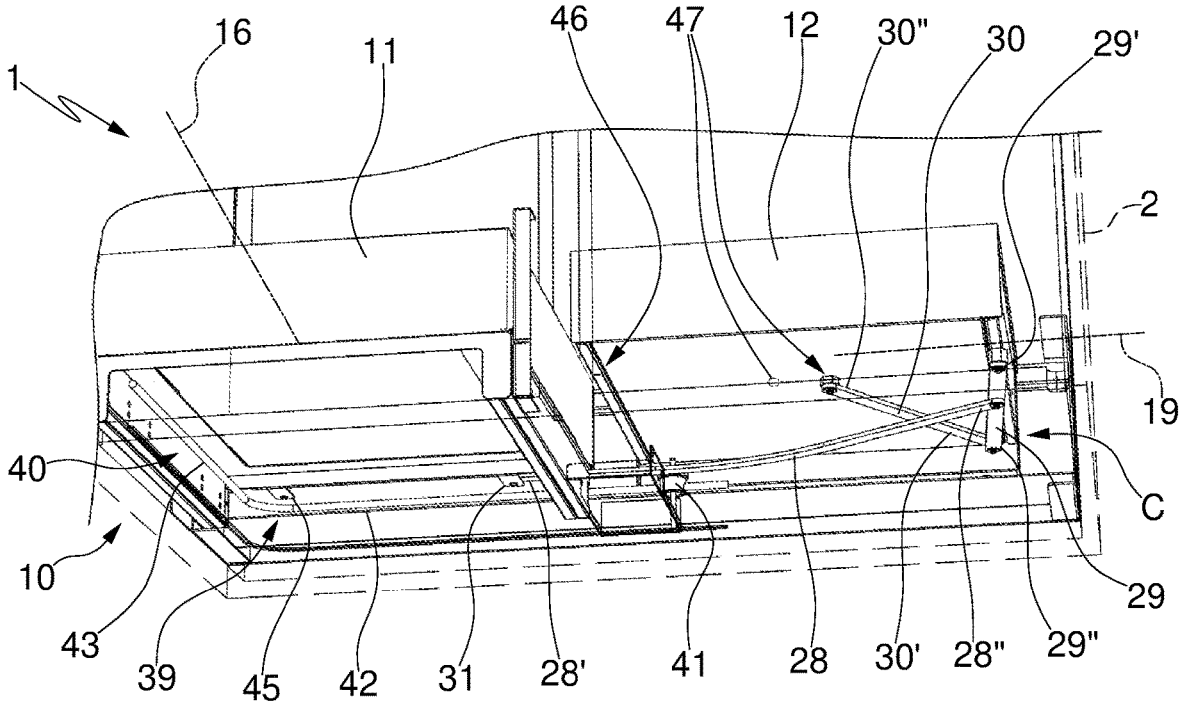
FIG. 7 is a detailed lower perspective view of the support and containment device pursuant to FIG. 6.
Figure 8:
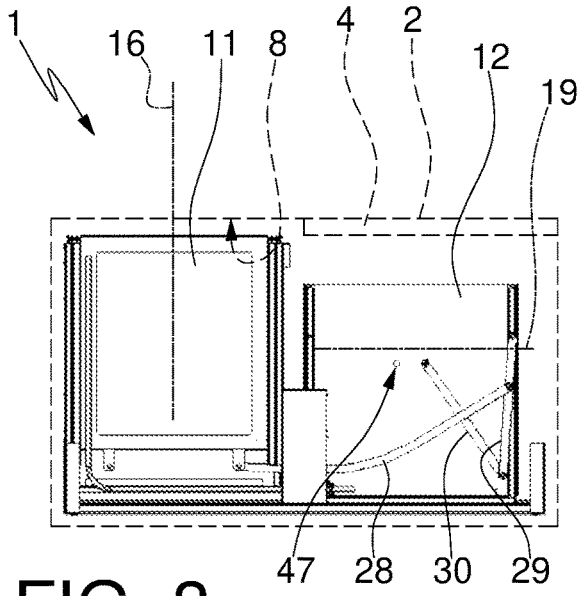
FIGS. 8 to 13 schematically illustrate a bottom view of the support and containment device pursuant to FIG. 6 in various operating positions.
Figure 9:
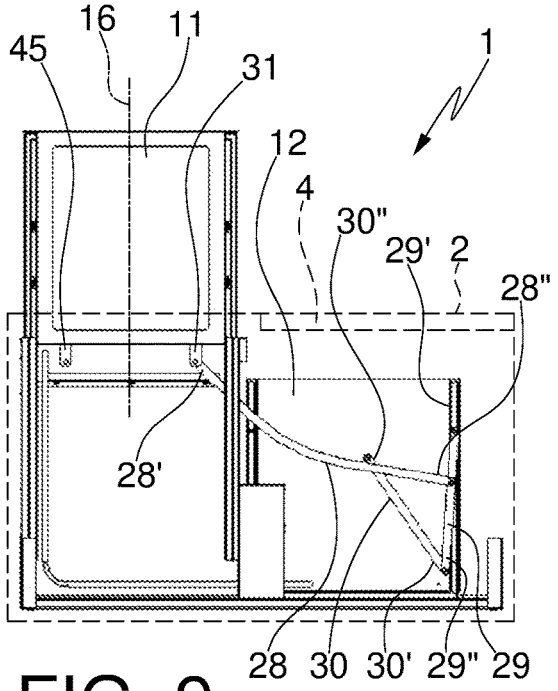

The first linear section 42 and the second linear section 43 are connected to each other by means of a curved connector in order to allow a smooth actuation, without points of discontinuity, so as to prevent sudden stops and shaking of the at least one second containment element 12 during its movement (see for example FIGS. 7 to 9).

The cam system 39 constitutes a system with complete constraints, adapted to guide the cam follower 41 along the cam path 40 during the reversible translation of the at least one first containment element 11 from the retracted position to the extracted position and vice versa.

According to one embodiment, the cam path 40 is configured as a bar element 44, with "L" shape, with which the cam follower 41 is associated.

In fact, the cam system 39 prevents the rotation of the at least one second containment element 12 during its movement between the position inside the corner cabinet 2, moved away from the off-centered opening 8, and the extracted position situated frontally with respect to the corner cabinet 2 and vice versa.

In summary, the operation is described of a movement device 1 comprising an above-described drive device 24, with reference to the enclosed FIGS. 8 to 13.

In the enclosed FIGS. 8 to 13, the movement device 1 is illustrated in bottom view and the planar bulk of the corner cabinet 2 together with the section of the front wall 4 are schematized with a non-continuous dashed line.

Initially, the at least one first containment element 11 is situated in retracted position within the corner cabinet 2, side-by-side the at least one second containment element 12 placed distal from the off-centered opening 8 (see FIG. 8).

Then, by acting on the at least one first containment element 11, one drives the same, moving it along the first drive direction 16, to be extracted from the off-centered opening 8 of the corner cabinet 2 (see FIG. 9). During such step, the first lever 28 completes a clockwise rotation, while the second lever 29 and the third lever 30 remain substantially stopped.

Figure 10:
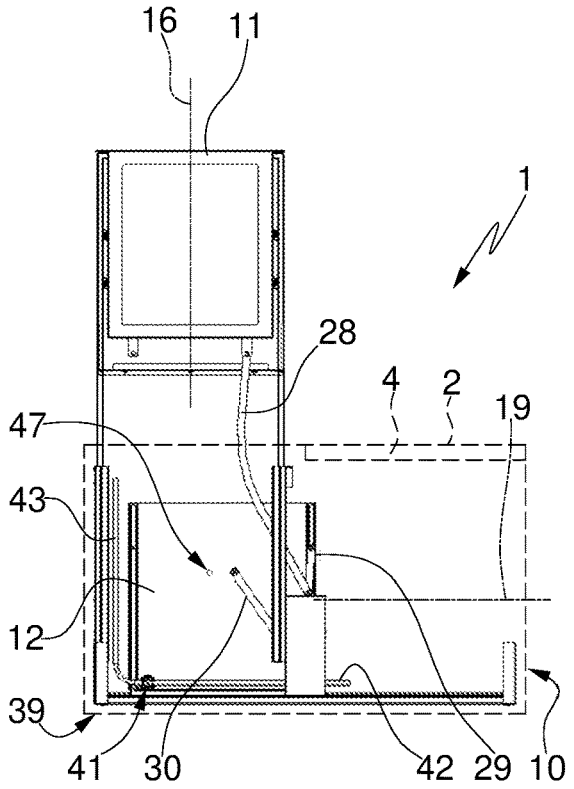

Continuing in the extraction of the at least one first containment element 11, the first lever 28 drives the at least one second containment element 12, moving it laterally along the second drive direction 19 from the retracted position, moved away from the off-centered opening 8, up to bringing it in proximity to the latter (see FIG. 10).

Figure 11:
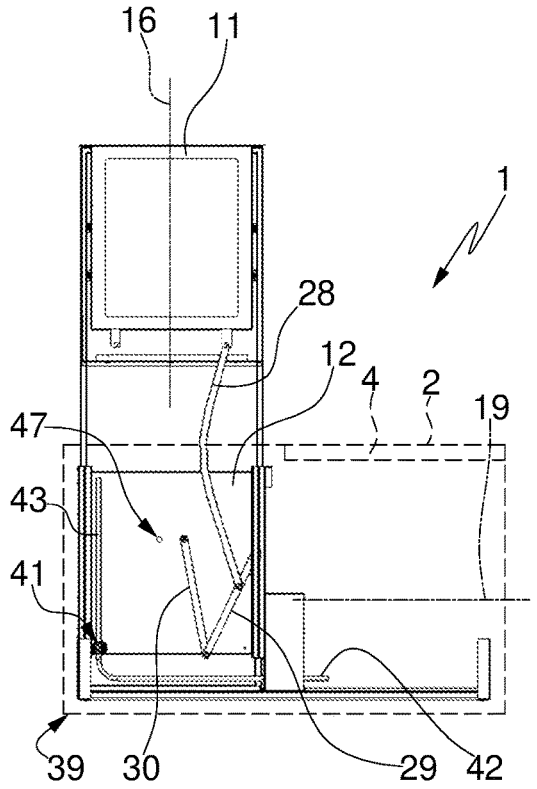

With the at least one first containment element 11 completely and frontally extracted from the corner cabinet 2, by continuing in its movement along the first drive direction 16, the at least one second containment element 12 is brought to face the off-centered opening 8 (see FIG. 11). The further movement of the at least one containment element 11 away from the corner cabinet 2 causes a further rotation of the first lever 28 which, in turn, sets a rotation on the second lever 29, in clockwise sense, which pushes the third lever 30, causing a rotation thereof in clockwise sense.

Simultaneously, the cam follower 41 is moved along the first section 42 of the cam path 40, up to reaching in proximity to the connector—curved portion—with the second section 43 of the cam path 40.

Figure 12:
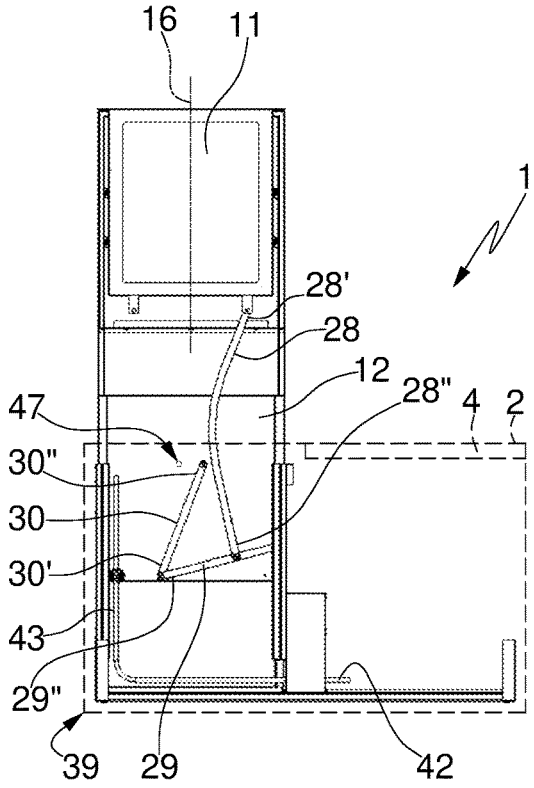

Continuing in the movement of the at least one first element 11 along the first drive direction 16, the first lever 28 exerts traction on the second lever 29 which, by continuing in its clockwise rotation, pushes the third lever 30 substantially along the first drive direction 16 (see FIG. 12). The cam follower 41, in this step, engages the second section 43 of the cam path 40, setting the translation of the at least one second containment element 12 along the first drive direction 16.

Then, while the at least one first containment element 11 reaches the final extraction position, the at least one second containment element 12 is driven outside the corner cabinet 2 due to the action of the second lever 29 which acts thrustingly against the third lever 30 which, in turn, pushes the at least one second containment element 12 closer to the at least one first containment element 11, outside the corner cabinet 2 (see FIG. 13).

In order to once again place the at least one first containment element 11 and the at least one second containment element 12 within the corner cabinet 2, one proceeds in a reverse manner, by acting thrustingly against the at least one first containment element 11 and causing the consequent movement of the at least one second containment element 12.

From that set forth above, it is evident that the movement device 1 comprising a drive device 24 is capable of accomplishing the set objectives and of overcoming the drawbacks of the abovementioned conventional movement devices, in the scope of a solution that is easy to use and with overall simple structure.

With respect to the solutions of the prior art which provide for the use of a hinge for the connection between the guide means of the at least one first containment element 11 and the corner cabinet 2, the present invention implements a technical solution capable of ensuring a smooth movement without sticking/jamming.

It is indicated that, according to the present invention, in order to extract both the first containment element 11 and the second containment element 12 it is sufficient to exert a simple traction of the first containment element 11 along the first drive direction 16. Indeed, the use of the movement device 1 is extremely simplified since the user, after having grasped the at least one first containment element 11, must only exert a traction action along a linear trajectory, unlike that which occurs in the solutions of conventional type which provide for a more articulated movement (traction and rotation).

According to a further aspect of the present invention, a same movement device 1 and the relative drive device 24 can be configured for use in a corner cabinet 2 with off-centered opening 8 on the right or left without requiring the manufacturing of specific components in order to obtain a right or left assembly configuration thereof.

On such matter, it is observed that the at least one first containment element 11 can have a connection point 31 and a further connection point 45 mirroring each other with respect to the containment element 11 itself, in order to allow the connection of the first lever 28 in right or left configuration relative to the at least one first containment element 11. Analogously, the third guide means 25 have respective connection points 46 mirroring each other relative to the second containment element 12, in order to allow the connection of the second lever 29 in right or left assembly configuration relative to the at least one second containment element 12 (see FIG. 6). On such matter, it is also indicated that the at least one second containment element 12 has seats 47, mirroring each other relative to the at least one second containment element 12 itself, for the connection of the third lever 30 in right or left assembly configuration.

In practice, for the assembly of the movement device 1 and of the drive device 24 in right assembly configuration (in case of installation in a corner cabinet 2 with a right off-centered opening 8) or in left assembly configuration (in case of installation in a corner cabinet 2 with left off-centered opening 8), it is sufficient to reverse the connection points of the drive system 24 to the movement device 1, without requiring the use of further components nor requiring the manufacturing of suitable right or left elements, thus allowing limiting the production costs.

Figure 14:
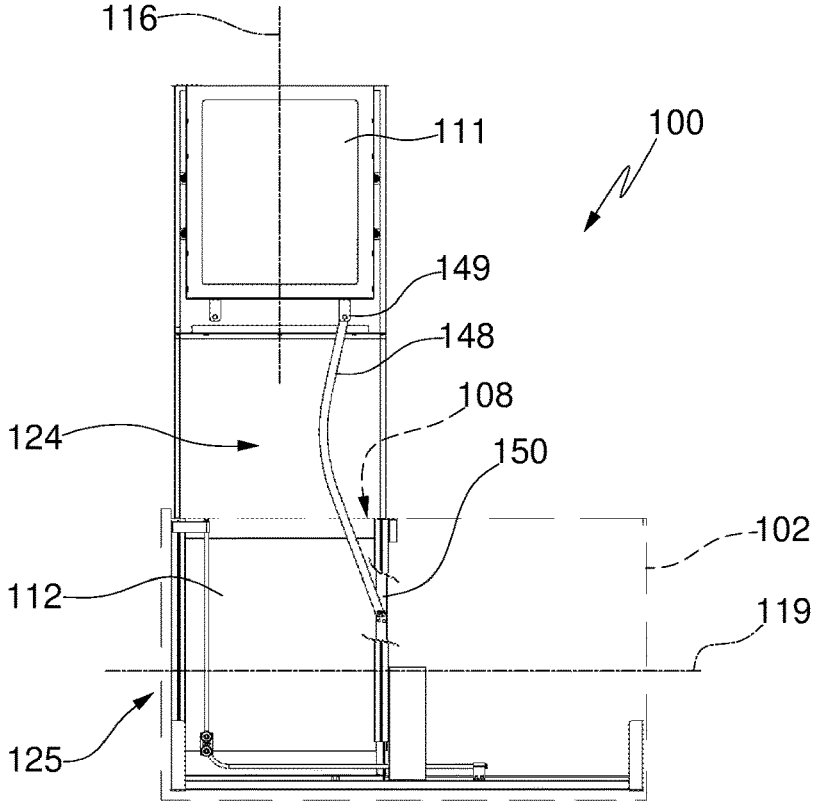
FIGS. 14 and 15 illustrate a further version of the support and containment device according to the present invention.
Figure 15:
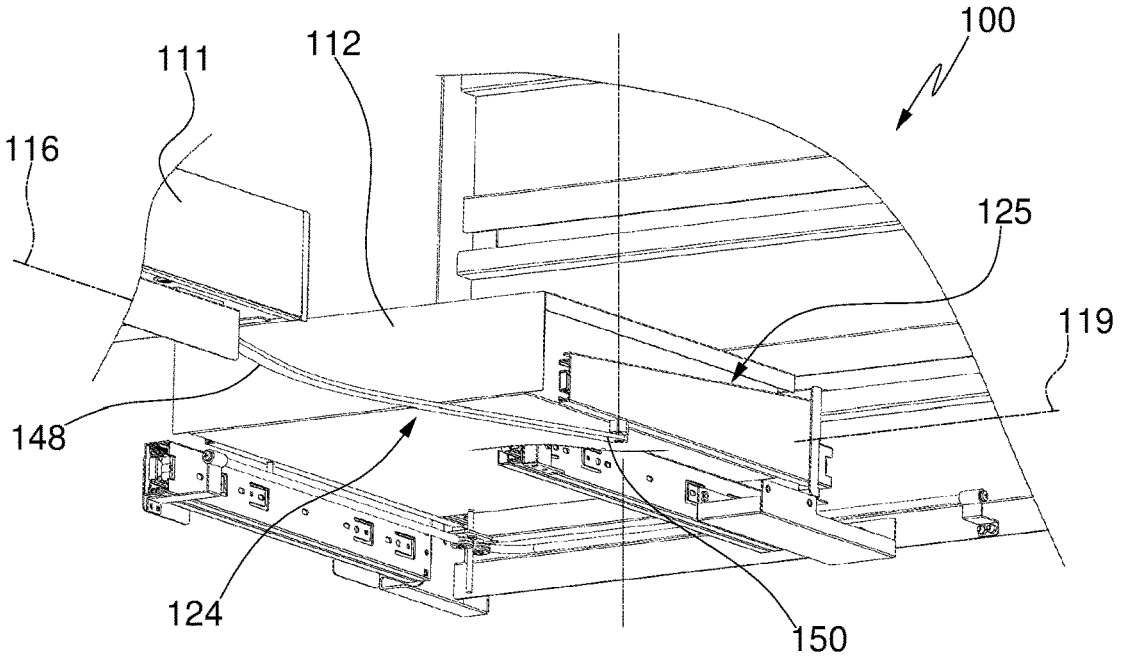

A further version of the movement device according to the present invention is illustrated in the enclosed FIGS. 14 and 15 and is overall indicated with reference number 100.

Hereinbelow, in order to indicate the components described above in relation to the preceding embodiments, the same reference numbers will be used but increased by one hundred.

In particular, it is observed that the movement device 100 substantially corresponds with the movement device 1 illustrated in FIGS. 6 to 13, being distinguished from the same in relation to the configuration of the drive device 124.

The drive device 124, analogous to the drive device 24, operatively connects together the at least one first containment element 111 with the at least one second containment element 112 in a manner such that, following the movement of the at least one first containment element 111, along the first direction 116, the movement of the at least one second containment element 112 is caused along the second direction 119.

The drive device 124, with respect to the drive device 24, has a simplified structure, and allows executing only part of the relative movement between the at least one first containment element 111 and the at least one second containment element 112 which can instead be obtained by the drive device 24.

As stated above, the drive device 124 allows the movement of the at least one second element 112 closer to or further away from the off-centered opening 108 of the corner cabinet 102 following the extraction or the insertion of the at least one first containment element 111 with respect to the corner cabinet 102 itself.

The drive device 124 comprises a rod 148 which has a first end 149 operatively connected to the at least one first containment element 111 and a second end 150, opposite the first, operatively connected to the at least one second containment element 112

More in detail, the first end 149 is hinged to a rear portion, rear during use, of the first containment element 111, at a connection point 131.

The second end 150 of the rod 148 is connectable, if desired removably, to the third guide means 125 associated with the at least one second containment element 112.

In fact, the second end 150 of the rod 148 is hinged to a lower portion of the third guide means 125.

The rod 148 is associable below the at least one first containment element 111 and the second containment element 112.

In summary, the operation of a movement device 100 is described hereinbelow.

Initially, the at least one first containment element 111 is situated in retracted position within the corner cabinet 102, side-by-side the at least one second containment element 112 which is placed distal from the off-centered opening 108 (see FIG. 8).

Then, one grasps the at least one first containment element 111, driving it along the first drive direction 116, to be extracted from the off-centered opening 108 of the corner cabinet 102. During such step, the lever 148 completes a clockwise rotation, exerting a traction action on the at least one second containment element 112 at the third guide means 125.

Following the extraction of the at least one containment element 111 from the corner cabinet 108, a movement of the at least one second containment element 112 along the second drive direction 119 is caused.

Continuing in the extraction of the at least one first containment element 111, the lever 148 drives the at least one second containment element 112, moving it laterally along the second drive direction 119, from the retracted position, moved away from the off-centered opening 108, up to bringing it in proximity to the latter (see FIG. 10).

With the at least one first containment element 111 completely extracted from the corner cabinet 102, the at least one second containment element 112 is brought to face the off-centered opening 108 (see FIG. 11).

Then, by grasping the at least one second containment element 112, it is possible to extract it at least partially from the corner cabinet 102 through the off-centered opening 108.

In order to reposition the at least one first containment element 111 and the at least one second containment element 112 in the initial configuration, one proceeds in a reverse manner, acting thrustingly against the at least one first containment element 112 and causing the consequent sliding of the at least one second containment element 112 along the second drive direction 119.

The movement device 100 allows attaining the same advantages described with reference to the preceding embodiments, in the scope of a solution that is simple to use and highly practical.

The above-described movement device 1, 100 is susceptible of numerous modifications and variations within the protective scope of the following claims.

The invention claimed is:

1. A movement device installed in a corner cabinet which has an off-centered opening, said off-centered opening identifying a vertical access plane within said corner cabinet, wherein said movement device comprises at least one frame for supporting at least one first containment element and at least one second containment element placeable mutually side by side, first guide means for translating said at least one first containment element along a first drive direction, said first drive direction being substantially perpendicular to said vertical access plane within said corner cabinet, and second guide means for translating said at least one second containment member along a second drive direction perpendicular to said first drive direction, wherein said first guide means are operably associated with said frame or with inner portions of said corner cabinet so as to allow movement of said at least one first containment element only along said first drive direction, and wherein the device comprises third guide means perpendicular to second guide means and operatively connected to said at least one second containment element and to said frame for moving said at least one second containment element along said first drive direction, whereby both said at least one first containment element and said at least one second containment element are extractable with respect to said vertical access plane.

2. The movement device according to claim 1, comprising a drive device or a rod adapted to connect said at least one first containment element-operatively to said at least one second containment element, so that as a result of the displacement of said at least one first containment element along said first drive direction, a corresponding displacement of said at least one second containment element is caused along said second drive direction.

3. The movement device according to claim 2, wherein said drive device comprises a system of articulated levers comprising in turn a first lever, a second lever and a third lever hinged to each other, wherein said first lever is operatively connected to said at least one first containment element and to said second lever, said second lever is connected to a third guide means, to said first lever and to said third lever and wherein said third lever is connected to said second lever and to said at least one second containment element so as to define an articulated system.

4. The movement device according to claim 3, wherein said first lever is hinged to said at least one first containment element at a connecting point, rotatable about a first rotation axis, and is hinged to said second lever, rotatable about a second rotation axis, wherein said second lever is hinged to said third guide means rotatable about a third rotation axis and is hinged to said third lever rotatable about a fourth rotation axis, wherein said third lever is hinged to said at least one second containment element, rotatable around a fifth rotation axis, said first rotation axis, said second rotation axis said third rotation axis, said fourth rotation axis and said fifth rotation axis being aligned parallel to each other and reciprocally movable following the movement of said at least one first containment element and said second containment element.

5. The movement device according to claim 3, wherein said first lever follows the movement of said at least one first containment element along a first stretch of said first drive direction, wherein said first lever exerts a force on said second lever causing the movement of said at least one second containment element along said second drive direction.

6. The movement device according to claim 5, wherein following the movement of said at least one first containment element along a second stretch of said first drive direction, said first lever exerts a force on said second lever, causing said second lever to rotate about a second rotation axis so as to cause a thrust action on said third lever along said first drive direction, for moving said at least one second containment element along said first drive direction.

7. The movement device according to claim 2, comprising a cam system comprising a cam path constrainable to said frame or to internal portions of said corner cabinet and a cam follower constrained below said at least one second containment element.

8. The movement device according to claim 7, wherein said cam path comprises a first linear section which develops aligned along said second drive direction and a second linear section which develops aligned to said first drive direction.

9. The movement device according to claim 8, wherein said first linear section and said second linear section are mutually connected by means of a curved section.

* * * * *